US008851563B2

(12) United States Patent
Hortig et al.

(10) Patent No.: US 8,851,563 B2
(45) Date of Patent: Oct. 7, 2014

(54) FURNITURE FITTING SYSTEM

(75) Inventors: Andreas Hortig, Halle (DE); Boris Besler, Guetersloh (DE)

(73) Assignee: Kintec-Solution GmbH, Rietberg (DE)

( * ) Notice: Subject to any disclaimer, the term of this patent is extended or adjusted under 35 U.S.C. 154(b) by 23 days.

(21) Appl. No.: 13/564,368

(22) Filed: Aug. 1, 2012

(65) Prior Publication Data

US 2013/0249263 A1 Sep. 26, 2013

(30) Foreign Application Priority Data

Mar. 22, 2012 (DE) ..... 10 2012 204 670

(51) Int. Cl.
*A47C 1/02* (2006.01)
*A61G 15/00* (2006.01)

(52) U.S. Cl.
USPC ..... 297/89; 297/334; 297/344.15; 297/85 R; 248/421; 248/370

(58) Field of Classification Search
USPC ..... 297/311, 331, 313, 334, 344.14, 297/344.15, 344.21, 344.22, 341, 84, 85 R, 297/85 L, 89; 296/65.06; 248/421, 370
See application file for complete search history.

(56) References Cited

U.S. PATENT DOCUMENTS 4,805,960 A * 2/1989 Tacker ..... 297/85 L
5,076,644 A * 12/1991 Northcutt ..... 297/330
5,466,046 A * 11/1995 Komorowski et al. ..... 297/325
6,142,558 A * 11/2000 May ..... 297/75
6,840,575 B2 * 1/2005 Hesse ..... 297/85 M
7,641,277 B2 * 1/2010 Lawson et al. ..... 297/85 L
7,766,421 B2 * 8/2010 Lawson ..... 297/85 R
8,096,616 B2 * 1/2012 Ventura et al. ..... 297/334
8,308,228 B2 * 11/2012 Lawson et al. ..... 297/330
2001/0035668 A1 * 11/2001 Gaffney et al. ..... 297/85
2006/0273631 A1 * 12/2006 White et al. ..... 297/85
2008/0150329 A1 * 6/2008 Lawson ..... 297/84

FOREIGN PATENT DOCUMENTS

DE 20 2004 016 889 U1 2/2005
DE 20 2007 004 695 U1 9/2008
DE 20 2011 105 589 U1 1/2012

OTHER PUBLICATIONS

German Patent Office Examination Report issued in German Application No. 10 2012 204 670.4 dated Jan. 29, 2013 (5 pages).

* cited by examiner

*Primary Examiner* — Chi Q Nguyen
(74) *Attorney, Agent, or Firm* — Flynn, Thiel, Boutell & Tanis, P.C.

(57) ABSTRACT

Fitting system including base seat surface and leg support segments. The seat surface segment is displaceable in relation to the base segment, and the leg support segment is pivotable between a storage position and a use position, and wherein the relative positions of the seat surface and leg support segments with respect to the base segment are forcibly coupled to each other. The seat surface segment is connected to the base segment by a first bracket. The leg support segment is pivotable about a pivot axis fixed in position with respect to the base and leg support segments. The leg support segment is connected to the seat surface segment by a second bracket pivotable about a pivot axis on the leg support and seat surface segment sides.

17 Claims, 5 Drawing Sheets

FURNITURE FITTING SYSTEM

FIELD OF THE INVENTION

The invention relates to a fitting system for an item of seating furniture and to an item of seating furniture with a fitting system of this type. The invention furthermore also relates to a method for adapting a fitting system with regard to the usability of the fitting systems for items of seating furniture of differing configuration.

BACKGROUND OF THE INVENTION

A fitting system of the type in question has at least three main components, namely a base segment for the fixed or rotatable attachment to a floor-side part of the item of seating furniture, a seat surface segment for the attaching of a seat surface, and a leg support segment for the attaching of a leg support surface. In the case of fitting systems of the type in question and according to the invention, the base segment may be connected fixedly to a foot of the item of furniture, said foot being provided for positioning in a fixed position. However, said base segment may also be movable to a limited extent in relation to an underlying surface by being attached to a foot or the like so as to be rotatable about a vertical or substantially vertical axis. The seat surface segment, which is correctly provided in a fixed position with respect to a seat surface and supports the latter, is displaceable in relation to the base segment. The leg support segment is pivotable between a storage position under the seat surface segment and a use position in front of the seat surface segment.

In the case of a fitting system of the type in question and according to the invention, the relative movability of the seat surface segment in relation to the base segment and of the leg support segment in relation to the base segment are forcibly coupled to each other. This should be understood as meaning that a certain relative position of the leg support segment with respect to the base segment inevitably arises from a predetermined relative position of the seat surface segment with respect to the base segment. With regard to an item of furniture having a fitting of this type, this means that, by displacement of the seat surface in relation to an underlying surface, the leg support can be transferred from a storage position into a use position.

It is known, at least from internal prior art, to realize the given relative movability of the seat surface segment with respect to the base segment by said seat surface segment and base segment being connected to each other by means of at least one first bracket. In this case, in conjunction with the present invention, a bracket is understood as meaning a mechanical component which is coupled to two different components so as to be pivotable about one pivot axis each, wherein the two pivot axes are parallel to each other and are spaced apart from each other.

In the case of a fitting system of the type in question, said first bracket is pivotable in relation to the base segment about a first pivot axis which is fixed in position with respect to the base segment and to the first bracket, and is pivotable in relation to the seat surface segment about a second pivot axis which is fixed in position with respect to the seat surface segment and to the first bracket. The abovementioned axes are preferably oriented in the transverse direction of the item of furniture.

The technique used in the prior art for the operative coupling of the relative position of the seat surface segment with respect to the base segment to the relative position of the leg support segment with respect to the base segment also comprises an alternative, in which a section of the seat surface segment slides along a contact surface of the leg support segment and, in the process, pivots the latter in relation to the base segment. However, it has been shown that this technique involves a plurality of disadvantages. A rather high degree of wear can be observed in this case, the wear initially being manifested in annoying noises and leading comparatively prematurely to failure of the mechanism. Also, it is fairly difficult to reuse a slideway of this type to realize a storage position of the leg support segment, in which the leg support is arranged virtually parallel to the seat surface. The adaptation of a system of this type to different possible storage positions is also complicated.

It is the object of the invention, with regard to a fitting system of the type in question, to develop the latter to the effect that the abovementioned operative coupling can be realized with little wear. It is furthermore the object of the invention to provide a simple possibility for being able to configure substantially constructionally identical fitting systems for different storage positions of the leg support segment without said different storage positions leading to different tilting angles of the seat surface segment in relation to the base segment when the leg support segment is stored.

According to the invention, this object is achieved in that the leg support segment is pivotable in relation to the base segment about a third pivot axis which is fixed in position with respect to the base segment and to the leg support segment, and is connected to the seat surface segment by means of a second bracket. In this case, said second bracket is pivotable in relation to the leg support segment about a fourth pivot axis which is fixed in position with respect to the leg support segment and to the second bracket, and is pivotable in relation to the leg support segment about a fifth pivot axis which is fixed in position with respect to the seat surface segment and to the second bracket.

Within the context of the invention, the components referred to should be understood as follows: the base segment of the fitting system is attachable for the fixed or rotatable attachment to a floor-side part of the item of seating furniture, in particular to a seating furniture foot or a seating furniture framework. Said base segment extends during operation under the seat surface segment preferably approximately as far as the front end of said segment. The seat surface segment is provided above the base segment and serves for the fixed attaching of the seat surface, which is preferably of upholstered design. The seat surface segment is preferably designed in the manner of a plate to which the seat surface upholstery is attached, or it is designed in the manner of an encircling or at least substantially encircling frame which supports the seat surface.

The leg support segment within the context of the invention is that part of the fitting which supports the leg support, which is preferably likewise upholstered, and by means of which the leg support is displaceable between the storage position and the use position. In this case, it should be noted that fitting systems according to the invention can be used both in the case of items of furniture in which the leg support has an invariable size and also in the case of systems in which the leg support can undergo an enlargement over the course of the displacement thereof. In the case of the last-mentioned systems, the fitting preferably additionally comprises a type of slider which is displaceable in a translatory manner in relation to the leg support segment in order to enlarge the leg support. A let support segment within the context of the invention is considered, in the case of a leg support having a plurality of fitting components movable in relation to one another, to be that fitting component which is assigned to the leg support and is movable exclusively pivotable in relation to the base segment.

In the case of fitting systems of the type in question and according to the invention, the seat surface segment is displaceable in relation to the base segment by means of at least one first bracket. For said first bracket, as for the second bracket provided according to the invention, two such first and second brackets are preferably provided in each case, the brackets being provided on the right-hand side and left-hand side respectively of a vertical centre plane of the item of furniture. However, within the context of the kinematic definition, only one bracket is in each case absolutely necessary.

In connection with the description of the present invention, the term of the vertical axis of the furniture refers to a correct positioning of the vertical axis of the item of furniture, said axis, in the case of a rotatable configuration of the base segment, preferably running parallel to the axis of rotation thereof. The transverse axis of the furniture refers to that direction which, during correct use of the item of furniture, extends transversely with respect to the seat surface, i.e. from the left to the right or from the right to the left. The longitudinal axis of the furniture refers to an axis which is orthogonal with respect to the transverse axis of the furniture and to the vertical axis of the furniture and therefore extends approximately in the direction of the thigh of a person sitting on the item of furniture. In this case, in conjunction with the longitudinal axis of the furniture, the term "at the front" refers to the direction pointing to the knees of said person and "at the rear" refers to the direction pointing in the direction of the backrest.

According to the invention, for the purpose of producing the desired operative coupling, provision is made for a second bracket to be provided in addition to the first bracket. Said second bracket extends between the seat surface segment and the leg support segment. By means of said second bracket, a pivoting movement of the leg support segment about the third pivot axis is forced when the seat surface segment is displaced in relation to the base segment. In this case, the fourth pivot axis, about which the second bracket is attached pivotably to the leg support segment, is preferably arranged relative to the third pivot axis and the support surface of the leg support segment in such a manner that the third pivot axis lies between the fourth pivot axis and the support surface. The effect which can be achieved by this means is that the second bracket and the coupling thereof to the leg support segment in the use position can scarcely be seen from the outside.

The production of the operative coupling between the position of the seat surface segment and the position of the leg support segment by means of the second bracket has proven to be a highly cost-effective and in particular very low-wearing route to solving the problem. In the present context, the pivot axes used here are advantageous in every respect in comparison to a slideway.

The first bracket, which serves for the movability of a front end of the seat surface segment in relation to the base part, is preferably supplemented by a further, third bracket at the rear end of the seat surface segment and of the base part, and therefore the seat surface segment is still only movable along a defined relative movement path in relation to the base segment.

The fitting according to the invention is intended by definition to be usable for different items of furniture, wherein, in particular, variations with regard to the desired storage position of the leg support segment are intended to be possible in a simple manner. The forced coupling via the second bracket is highly advantageous for this purpose, since it permits force to be transmitted from the seat surface segment to the leg support segment over extensive pivoting angle ranges of the leg support segment. However, the coupling via the second bracket is also associated with the fact that the seat surface segment takes up a different position in relation to the base part depending on the end position, and therefore the storage position, of the leg support segment. Therefore, a development of a fitting system according to the invention is considered to be particularly advantageous, in which the seat surface segment comprises at least two components, namely, firstly, a tubular frame which bounds the seat surface segment at least on the right-hand side and left-hand side and the front side, wherein such a frame is preferably constructed from hollow tubes. Secondly, this development provides an extension arm part which is connected fixedly to the seat frame by means of a screw connection, a rivet connection or a welding connection. Said extension arm part is a carrier of the second and/or fifth pivot axis, wherein hinge means are preferably provided for this purpose on the extension arm part.

The extension arm part preferably extends downwards from a front-side transverse strut of the seat frame. It is not itself an integral part of the seat frame but rather is connected to said seat frame by means of one of the above mentioned connecting techniques. This makes it possible to adapt said component in a simple manner for the production of a desired alternative of the fitting system. The extension arm part therefore forms a type of compensating part. The fitting system according to the invention could therefore be constructed from the same components in each case, for example for three different storage positions of the leg support segment. The sole exception would be the extension arm part or a plurality of such extension arm parts which, by means of the selection on a case-by-case basis for each of the models, have the effect that, in spite of different storage positions of the leg support segments, the relative position of the seat surface segment with respect to the base segment, or at least the relative tilting position, would be identical in each case irrespective of the specific storage position of the leg support segment. As an alternative thereto, for the provision of different extension arm parts for otherwise unchanged fitting systems, it would also be possible to provide extension arm parts which are adjusted on a case-by-case basis at the factory in order to permit a variable spacing of the fifth pivot axis in relation to an attachment surface on the seat frame.

The second pivot axis and the fifth pivot axis are both provided in a fixed position with respect to the seat surface segment. They are preferably even identical such that both the first and the second bracket are pivotable in relation to the seat surface segment about an identical pivot axis. Costs for the hinge means in this regard are therefore saved, and, by means of the interchanging of the abovementioned extension arm part, the spacing both of the second and of the fifth pivot axis from the seat frame is influenced at the same time.

The second bracket, which primarily serves for the operative coupling of the relative movement of the seat surface segment in relation to the base segment for the relative movement of the leg support segment in relation to the base segment, can take on a further function. It is considered to be advantageous if, in the case of a fitting system according to the invention, the base segment is provided with a first stop surface against which the leg support segment, or preferably the second bracket, is pressed when the leg support segment is arranged in the use position. An admission of force to the seat surface, i.e., in particular, the admission of force caused by the weight of the seated person there, can therefore be introduced in a simple manner from the seat surface segment into the base segment. The stop surface on the base segment is preferably provided as a depression into which a section of the leg support segment or, preferably, the second bracket enters during the movement of the leg support segment into the use position thereof.

In order, in a particularly stable manner, to ensure the positioning of the leg support segment in the use position thereof, it is advantageous if the brackets and the arrangements of the pivot axes are selected in such a manner that, when the leg support segment is positioned in the use position, the second bracket stands substantially vertically. In this case, the orientation of the second bracket is determined by an imaginary connecting line of the fourth and fifth pivot axes. When the leg support segment is in the use position, said imaginary connecting line preferably encloses an angle of less than 20°, in particular less than 10°, with the vertical direction of the furniture. Said substantially vertical orientation of the second bracket results in a considerable portion of the weight pressing the leg support segment in the direction of the use position thereof. The problem frequently encountered in the case of known items of seating furniture that even the leg load suffices in order to prevent reliable retention of the use position of the leg support segment is hereby overcome.

The invention furthermore relates to an item of seating furniture comprising a floor-side part, for example a furniture framework or a furniture foot, a seat surface, which is preferably designed as an upholstered seat surface, and a leg support which is either of fixed size or variable size and is transferable in a pivotable manner between a storage position and a use position. Such an item of seating furniture according to the invention has a fitting system of the type described.

The item of seating furniture is understood as both an armchair provided for one person and sofas. In the case of sofas, configurations are conceivable in which the entire seat surface is displaceable as a whole in relation to the base segment, and also configurations in which individual seats of the sofa are each movable independently of one another in relation to the base segment.

An item of seating furniture according to the invention may be provided with an electric motor for displacing the seat surface segment in relation to the base segment. In addition, non-motorized configurations are also possible, said configurations being handleable, for example, by weight displacement or by means of an actuating lever.

The invention furthermore also relates to a method for adapting a fitting system of the above-described type with regard to the obtaining of a predetermined tilting position of the seat surface segment in the case of a variable storage position of the leg support segment. Said method makes provision for the above-described extension arm part to be selected for the purpose of adaptation or to be adapted. The other components of the fitting system remain unchanged.

The method according to the invention therefore makes it possible first of all to substantially completely fit standard fittings in order then exclusively to adapt the extension arm part, as required. This may be undertaken via an adjustable extension arm part and also via the selection of one of a plurality of predetermined extension arm parts.

BRIEF DESCRIPTION OF THE DRAWINGS

Further aspects and advantages of the invention emerge from the claims and from the description below of a preferred exemplary embodiment of the invention, which is explained with reference to the figures, in which:

DETAILED DESCRIPTION

Figure 1:
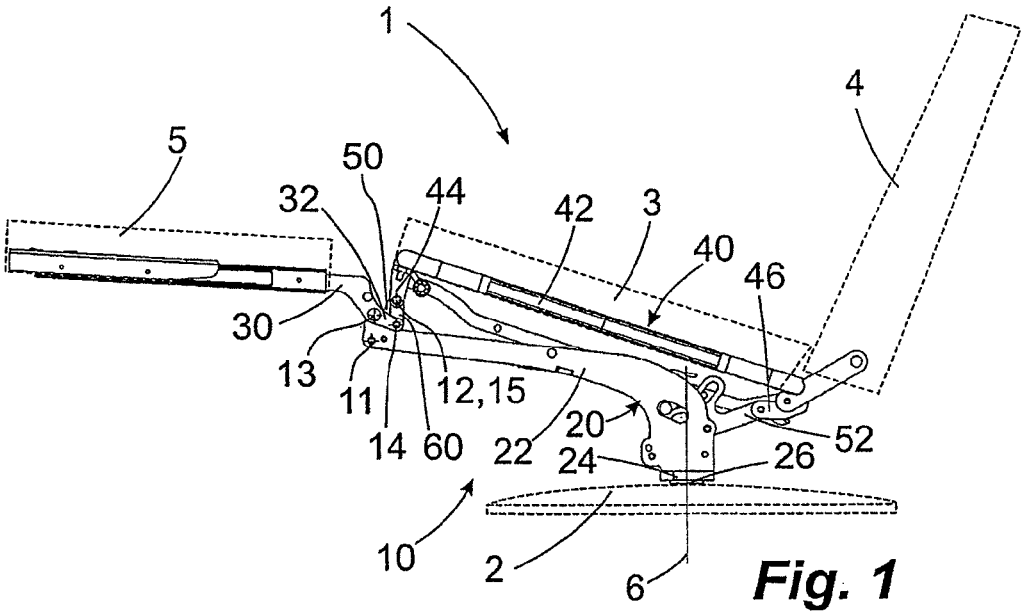
FIGS. 1 and 2 show an item of seating furniture according to the invention in a side view, illustrated in a state with a leg support being arranged in a storage position and in a state with the leg support being arranged in a use position.

FIG. 1 shows an item of seating furniture according to the invention in the manner of a swivel chair. A fitting 10 according to the invention is used in said swivel chair 1.

In addition to said fitting 10, the swivel chair 1 has a foot 2, an upholstered seat surface 3, a backrest 4 and a likewise upholstered leg support 5. Those parts of the item of seating furniture 1 which do not belong to the fitting 10 are illustrated by dashed lines in the figures.

Said abovementioned components are connected to one another by the fitting 10 and are movable in relation to one another by means of the fitting 10, as is explained below.

The fitting 10 is substantially constructed from metallic sheet-metal parts. It has a base segment 20 as the main component. In the manner which is readily apparent in the middle illustration, for example in FIG. 3*a*, said base segment 20 comprises two cheeks 22 which are spaced apart from each other and are oriented parallel to each other and are connected to each other via a connecting section 24. The connecting section 24 is provided with a rotary sleeve 26, by means of which the base segment 20 is connected to the foot 2 and is rotatable in relation to the foot 2 about a vertical axis of rotation 6.

Above the base segment 20, a seat surface segment 40 of the fitting 10 is provided, said seat surface segment consisting of an encircling tubular frame 42 and of extension arm components 44, 46 attached thereto on the front side and rear side. The extension arm part 44 is fixedly connected to the tubular frame 42 by means of a screw connection. Other releasable connections, for example a plug-in system/click system, and unreleasable connections, such as rivet connections and welding connections, are also possible here. Said extension arm part could alternatively also be riveted on or welded on. The seat surface segment 40 is connected to the upholstered seat surface 3 in a manner not illustrated specifically such that the seat surface 3 is always displaceable together with the seat surface segment 40, which is movable in relation to the base segment 20.

The relative movability between the seat surface segment 40 and the base segment 20 is obtained by means of a double bracket connection. Both the extension arm 44 at the front end of the seat surface segment and the extension arm 46 at the rear end of the seat surface segment are respectively coupled pivotably to two brackets 50, 52 which are coupled pivotably at the opposite ends thereof in each case to the base segment 20. The front brackets 50 are pivotable in relation to the base segment 20 about a first pivot axis 11 and in relation to the seat surface segment 40 about a second pivot axis 12. It follows from the connection of the seat surface segment 40 to the base segment 20 by means of two pairs of brackets having brackets 50, 52 that the seat surface segment 40 is movable in relation to the base segment 20 along a defined movement path.

The leg support segment 30 is movable in relation to the base segment 20 and in relation to the seat surface segment 40. Said leg support segment 30 serves for the purpose of permitting a transfer of the chair from the state in FIG. 2, in which the leg support 5 is arranged under the seat surface 3, into the comfort state of FIG. 1, in which the leg support 5 is arranged in front of the seat surface 3 and therefore takes up the use position. As is apparent with reference to the illustrations of FIGS. 1 and 2, the leg support segment 5 is not only pivoted, but also extended, for this purpose such that it changes the length thereof. However, in conjunction with the present invention, the change in length of the leg support segment 5, which can be realized, for example, via a belt driving system/traction system or the like, is of secondary importance.

The mechanical connection of the leg support segment 30 of the fitting 10 to the base segment 20 and the seat surface segment 40 is of particular importance in conjunction with the invention below.

The leg support segment 30 is pivotable in relation to the base segment 20 about a third pivot axis 13, wherein said pivot axis 13 is fixed in position both with respect to the leg support segment 30 and to the base segment 20. An extension arm 32, to which a leg support bracket 60 is coupled so as to be pivotable about a fourth pivot axis 14, is provided, with regard to the third pivot axis 13, on the side opposite the upholstery of the leg support 5. The opposite end of said leg support bracket 60 is pivotable about a fifth pivot axis 15 which coincides with the second pivot axis 12 in the case of the exemplary embodiment described here. However, this correspondence is not compulsory.

Figure 2:
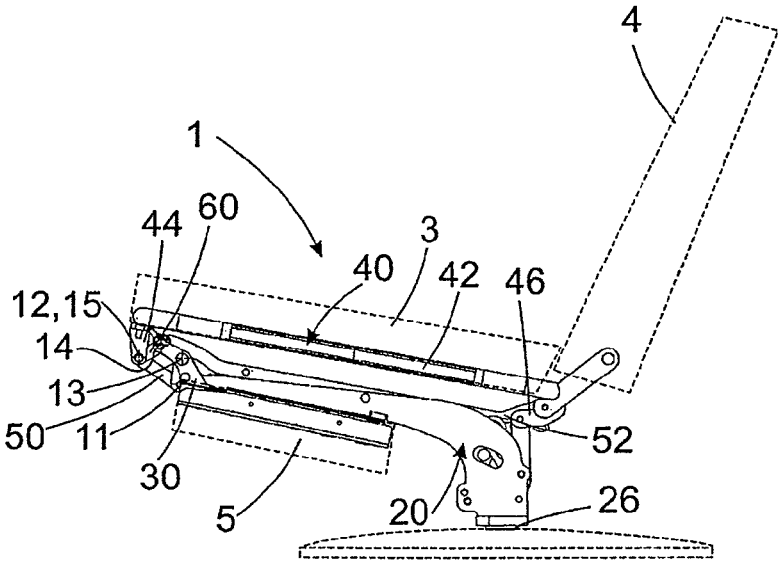

The connection of the leg support segment 30 to the base segment 20 via the third pivot axis 13 and to the seat surface segment 40 by means of the leg support bracket 60, which is pivotable about the fourth and fifth pivot axes 14, 15, results in the relative movement of the seat surface segment 40 in relation to the base segment 20 also bringing about the pivoting movement, which is clarified by FIGS. 1 and 2, of the leg support This is explained once again below with reference to FIGS. 3*a* to 3*c*.

Figure 3A:
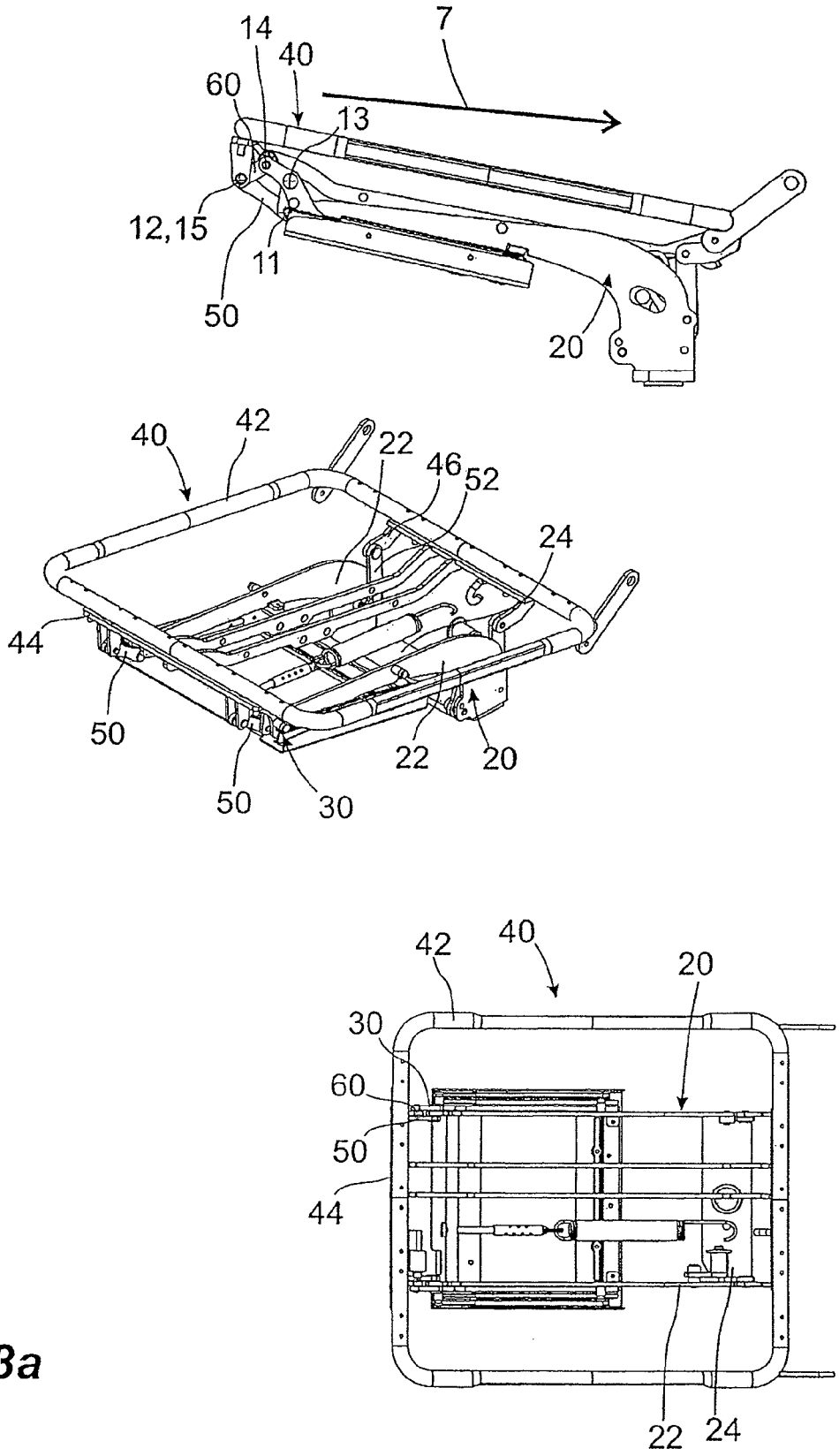
FIGS. 3*a* to 3*c* show a fitting of the item of seating furniture from FIGS. 1 and 2 in various stages during the transfer of the leg support from the storage position of FIG. 3*a* into the functional position of FIG. 3*c*, FIGS. 4*a* to 4*c* show three different alternatives of the fitting from FIGS. 3*a* to 3*c*, said alternatives being configured for different storage positions of the leg support segment.

FIG. 3*a* shows the fitting 10 from various perspectives in the state from FIG. 2, in which the leg support 5 is arranged below the seat surface 3 and therefore takes up the storage position thereof. If, starting from said position, the seat surface segment 40 together with the seat surface 3 is displaced to the rear in relation to the base segment 20 in the direction of the arrow 7, this is undertaken with regard to the front end of the seat surface segment 40 by the bracket 50 implementing a movement of the pivot axis 12 along a circular path about the pivot axis 11. Said movement is therefore associated with the pivot axis 12 and the pivot axis 15, which is identical to the latter, together being brought closer to the pivot axis 13. Owing to the indirect coupling via the leg support bracket 60, said displacement results in a pivoting of the leg support segment 30 in the clockwise direction with respect to FIG. 3*a*.

Figure 3B:
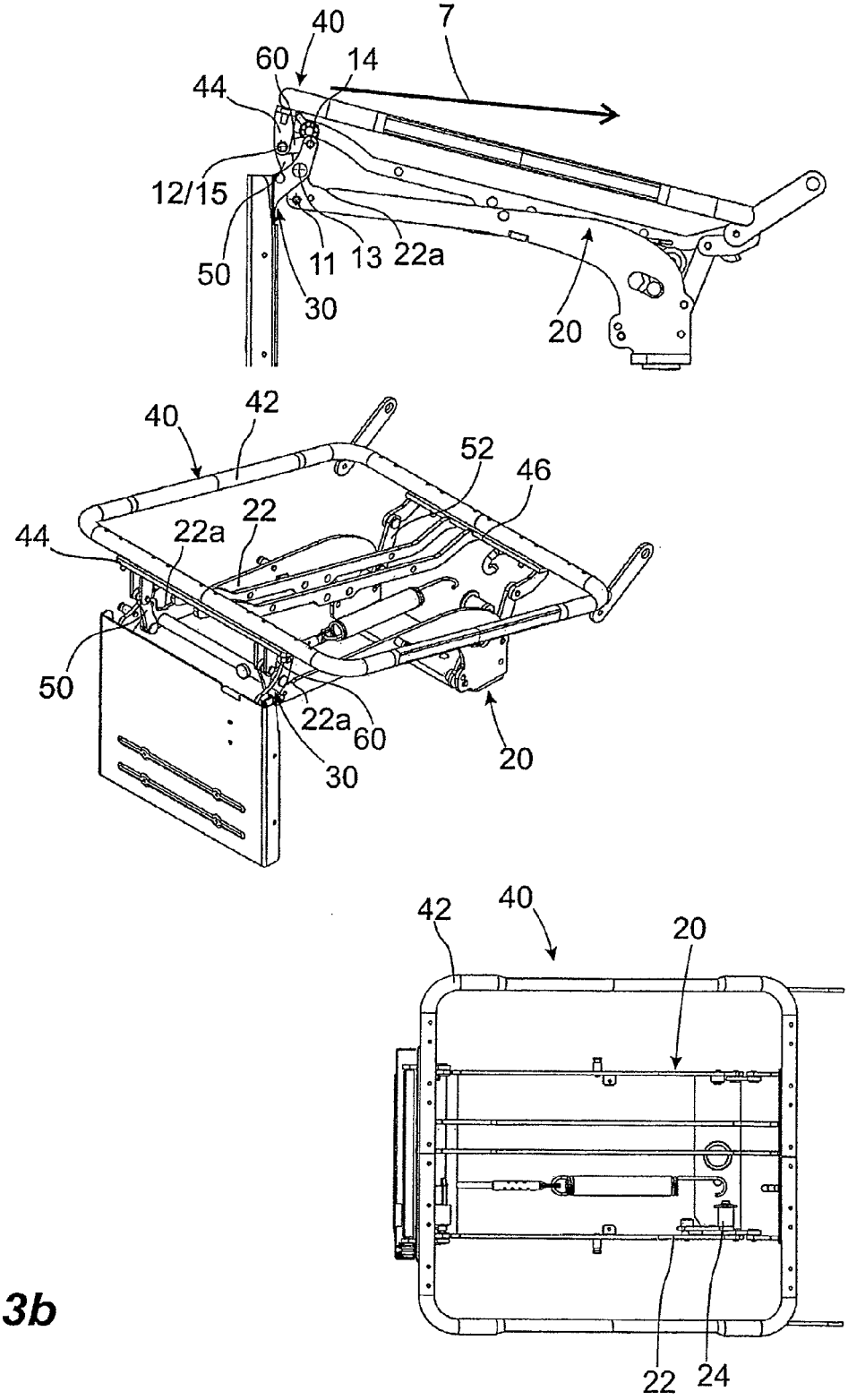

Said pivoting movement of the leg support segment 30 about the pivot axis 13 continues with increasing displacement of the seat surface segment 40 in the direction of the arrow 7, as is clarified by the intermediate state in FIG. 3*b*.

Figure 3C:
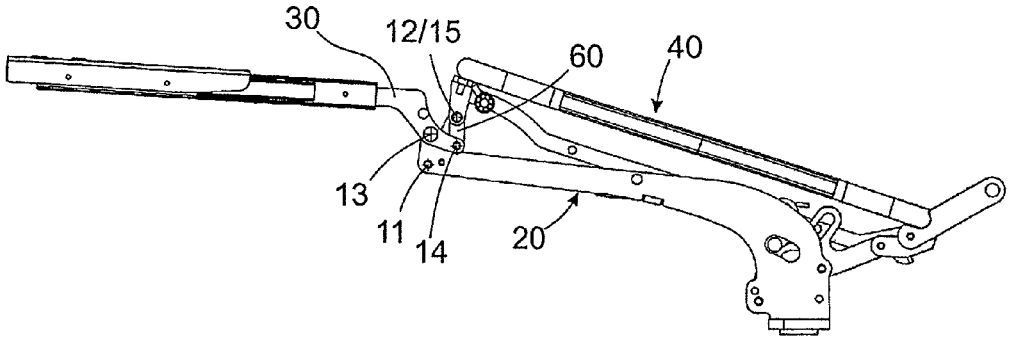
Figure 3C:
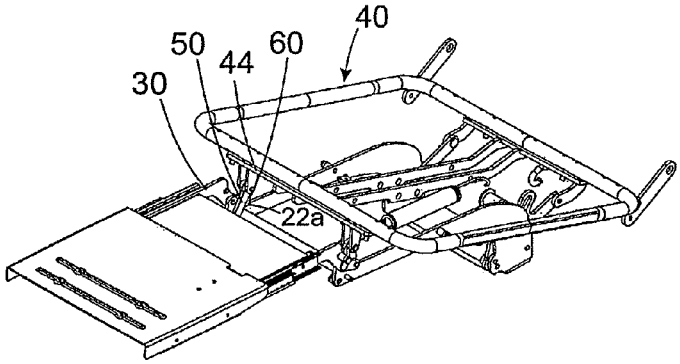
Figure 3C:
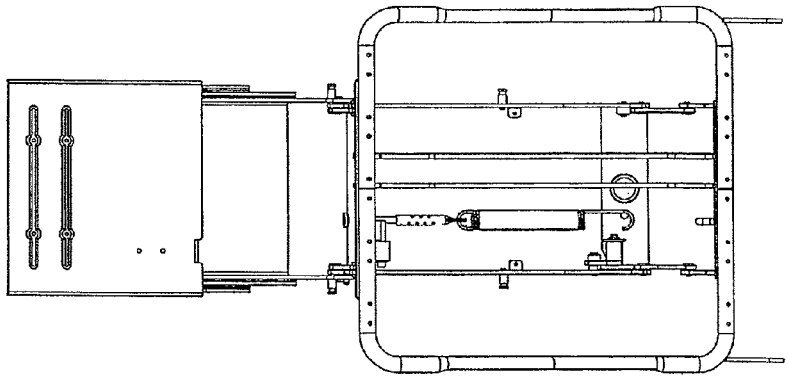

In the configuration in FIGS. 3*a* to 3*c*, pivoting of the leg support segment 30 through virtually 180° is provided. The pivoting movement ends in a defined manner when, in the manner apparent from FIG. 3*c*, the leg support bracket 60 comes to rest with the ends thereof pointing towards the leg support segment in depressions 22*a*, which serve as a stop, in the cheeks 22 of the base segment 20.

The relative arrangement of the pivot axes 11 to 15 is designed such that the defined end position of the leg support segment 30 is reached when the leg support bracket 60 has a virtually vertical orientation (+/−)15°. This is readily apparent in the upper illustration of FIG. 3*c*. The vertical orientation ensures that the weight of the person sitting on the seat surface 3 leads to a retaining moment which acts in the clockwise direction and by means of which the leg support segment 30 and the leg support 5 are held as a whole in the position of FIGS. 1 and 3*c*. The comfort position illustrated is therefore very stable and is not threatened to be undesirably reset by the weight of the seated person's legs.

Figure 4A:
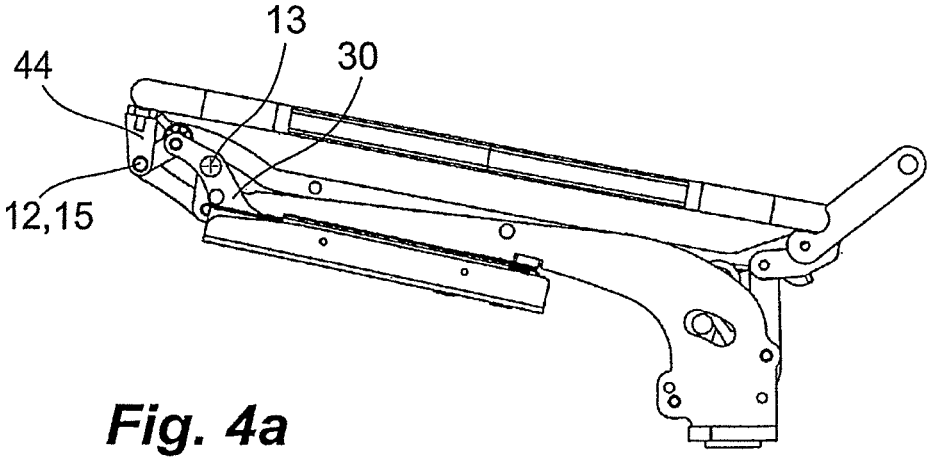
Figure 4B:
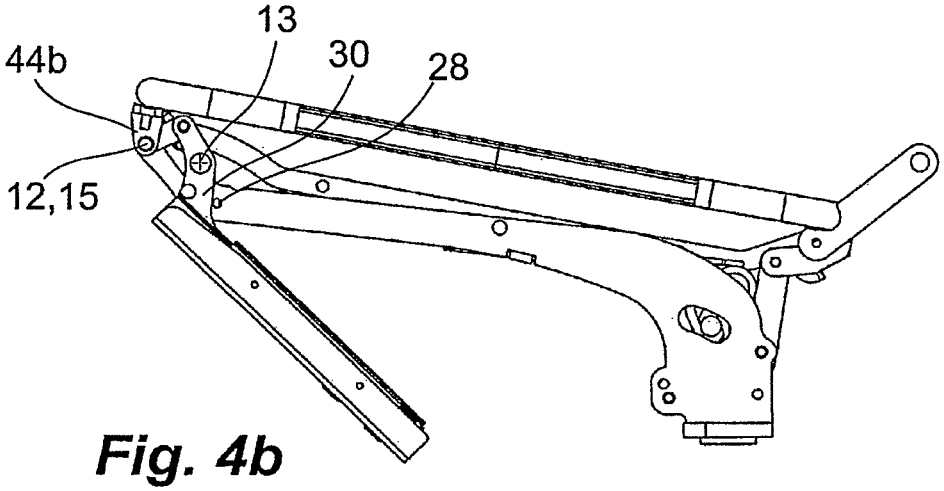
Figure 4C:
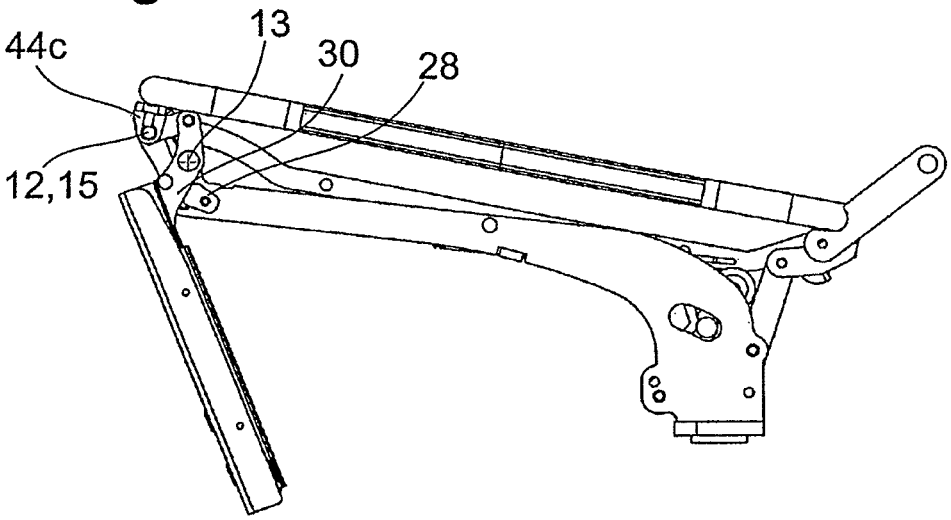

FIGS. 4*a* to 4*c* show three fittings of the type described. The fittings differ in that they are designed for providing different storage positions of the leg support segment.

The fitting of FIG. 4*a* corresponds to the fitting of the preceding figures. Said fitting makes provision for the leg support segment to be pivoted virtually through 180° from the use position before reaching the storage position.

By contrast, the fitting of FIG. 4*b* is designed in such a manner that it only permits pivoting through approximately 130°. In the storage position, the leg support segment 30 is therefore pivoted to a smaller extent than in the case of the fitting of FIG. 4*a*. A stop 28 which prevents a continuing movement of the leg support segment 30 is provided on the base part 22 in order to limit the pivotability of the leg support segment 30.

The fitting of FIG. 4*c* has pivotability which is further restricted in comparison to the configuration of FIG. 4*b*. In this configuration, the leg support segment 30 is inclined in the storage position thereof only by approximately 20° in relation to a vertical direction. The configuration of FIG. 4*c* also has a base segment side stop 28 in order to prevent the leg support segment 30 from pivoting beyond the position in FIG. 4*c*.

It is apparent from said storage positions in FIGS. 4*b* and 4*c*, which positions are changed in relation to the exemplary embodiment of FIG. 4*a*, that the pivot axes 12, 15 are arranged significantly higher than the base part 20 in the storage position of the leg support segment 30. In order to compensate for this, the front extension arm part 44*b*, 44*c* in said configurations is shortened. Accordingly, the extension arm part 44, 44*b*, 44*c* constitutes a compensating element which, by means of the specific dimensions thereof and in particular the spacing of the pivot axes 12, 15 in relation to the seat frame part 40, permits a setting of the oblique position of the seat surface segment 40 in the storage position of the leg support.

Although the pivot axes 12, 15 are at different heights, the angle of inclination of the seat surface segments in the alternatives of FIGS. 4*a*, 4*b* and 4*c* is approximately identical.

The configuration according to the invention of the fitting with the explained configuration of components which are movable in relation to one another can therefore be very simply adapted for different storage position configurations. For adaptation to a predetermined storage position, the fitting 10 needs to be changed only in respect of the selected extension arm part 44, 44*b*, 44*c* and in respect of the stops 28 which are additionally provided on the base part 20 and are optionally matched on a case-by-case basis.

The invention claimed is:

1. A fitting system for an item of seating furniture, comprising:

a base segment for fixed or rotatable attachment to a floor-side part of the item of seating furniture;

a seat surface segment for attachment of a seat surface; and a leg support segment for attachment of a leg support surface;

wherein the seat surface segment is displaceable in relation to the base segment, the leg support segment is pivotable between a storage position under the seat surface segment and a use position in front of the seat surface segment, and a relative position of the seat surface segment with respect to the base segment and a relative position of the leg support segment with respect to the base segment are forcibly coupled to each other;

wherein the seat surface segment is connected to the base segment by at least one first bracket;

wherein the first bracket is pivotable in relation to the base segment about a first pivot axis which is positionally fixed with respect to the base segment and to the first bracket;

wherein the first bracket is also pivotable in relation to the seat surface segment about a second pivot axis, with the second pivot axis being fixed in position with respect to the seat surface segment and with respect to the first bracket and being spaced apart in relation to the first pivot axis;

wherein the leg support segment is pivotable in relation to the base segment about a third pivot axis which is positionally fixed with respect to the base segment and to the leg support segment;

wherein the leg support segment is connected to the seat surface segment by a second bracket;

wherein the second bracket is pivotable in relation to the leg support segment about a fourth pivot axis which is positionally fixed with respect to the leg support segment and to the second bracket; and wherein the second bracket is also pivotable in relation to the leg support segment about a fifth pivot axis which is positionally fixed with respect to the seat surface segment and to the second bracket.

2. The fitting system according to claim 1, wherein the seat surface segment at least comprises:

a seat frame which bounds the seat surface at least on a right-hand side, a left-hand side and a front side; and an extension arm part which is fixedly connected to the seat frame by a screw connection, a rivet connection or a welding connection;

wherein the second pivot axis and/or the fifth pivot axis are/is formed by a hinge on the extension arm part.

3. A method for adapting the fitting system according to claim 2 with regard to obtaining a predetermined tilting position of the seat surface segment in during a variable storage position of the leg support segment, including selecting one of various extension arm parts.

4. The fitting system according to claim 1, wherein the second pivot axis and the fifth pivot axis are colinear in both the storage position and the use position.

5. The fitting system according to claim 1, wherein the base segment is provided with a first stop surface against which the leg support segment or the second bracket is pressed when the leg support segment is arranged in the use position.

6. The fitting system according to claim 1, wherein the second bracket is oriented substantially vertically when the leg support segment is arranged in the use position.

7. An item of seating furniture, comprising:

a floor-side part;

a seat surface;

a leg support opposite thereto; and the fitting system according to claim 1.

8. A fitting system for an item of seating furniture comprising:

a unitary, rigid base segment for attachment to a floor-side part;

a unitary, rigid seat surface segment for supporting a seat surface; and a unitary, rigid leg support segment for supporting a leg support surface;

the unitary, rigid seat surface segment being displaceable in relation to the unitary, rigid base segment;

the unitary, rigid leg support segment being pivotable between a storage position under the unitary, rigid seat surface segment and a use position in front of the unitary, rigid seat surface segment, and a relative position of the unitary, rigid seat surface segment with respect to the unitary, rigid base segment and a relative position of the unitary, rigid leg support segment with respect to the unitary, rigid base segment are forcibly coupled to each other;

the unitary, rigid seat surface segment being connected to the unitary, rigid base segment by at least one first bracket;

the first bracket being pivotable in relation to the unitary, rigid base segment about a first pivot axis which is positionally fixed with respect to the unitary, rigid base segment and to the first bracket;

the first bracket also being pivotable in relation to the unitary, rigid seat surface segment about a second pivot axis, with the second pivot axis being fixed in position with respect to the unitary, rigid seat surface segment and with respect to the first bracket and being spaced apart in relation to the first pivot axis;

the unitary, rigid leg support segment being pivotable in relation to the unitary, rigid base segment about a third pivot axis which is positionally fixed with respect to the unitary, rigid base segment and to the unitary, rigid leg support segment;

the unitary, rigid leg support segment being connected to the unitary, rigid seat surface segment by a second bracket;

the second bracket being pivotable in relation to the unitary, rigid leg support segment about a fourth pivot axis which is positionally fixed with respect to the unitary, rigid leg support segment and to the second bracket; and the second bracket also being pivotable in relation to the unitary, rigid leg support segment about a fifth pivot axis which is positionally fixed with respect to the unitary, rigid seat surface segment and to the second bracket.

9. The fitting system according to claim 8, wherein:

the unitary, rigid seat surface segment at least comprises:

a seat frame which bounds the seat surface at least on a right-hand side and a left-hand side and a front side; and an extension arm part which is fixedly and non-rotatably connected to the seat frame;

the second pivot axis and/or the fifth pivot axis are/is formed by a hinge on the extension arm part.

10. The fitting system according to claim 8, wherein:

the second pivot axis and the fifth pivot axis are colinear in both the storage position and the use position.

11. The fitting system according to claim 8, wherein:

the unitary, rigid base segment is provided with a first stop surface against which the unitary, rigid leg support segment or the second bracket is pressed when the unitary, rigid leg support segment is arranged in the use position.

12. The fitting system according to claim 8, wherein the second bracket is oriented substantially vertically when the unitary, rigid leg support segment is arranged in the use position.

13. An item of seating furniture comprising:

a unitary, rigid base segment attached to a floor-side part;

a unitary, rigid seat surface segment supporting a seat surface; and a unitary, rigid leg support segment supporting a leg support surface;

the unitary, rigid seat surface segment being displaceable in relation to the unitary, rigid base segment;

the unitary, rigid leg support segment being pivotable between a storage position under the unitary, rigid seat surface segment and a use position in front of the unitary, rigid seat surface segment, and a relative position of the unitary, rigid seat surface segment with respect to the unitary, rigid base segment and a relative position of the unitary, rigid leg support segment with respect to the unitary, rigid base segment are forcibly coupled to each other;

the unitary, rigid seat surface segment being connected to the unitary, rigid base segment by at least one first bracket;

the first bracket being pivotable in relation to the unitary, rigid base segment about a first pivot axis which is positionally fixed with respect to the unitary, rigid base segment and to the first bracket;

the first bracket also being pivotable in relation to the unitary, rigid seat surface segment about a second pivot axis, with the second pivot axis being fixed in position with respect to the unitary, rigid seat surface segment and with respect to the first bracket and being spaced apart in relation to the first pivot axis;

the unitary, rigid leg support segment being pivotable in relation to the unitary, rigid base segment about a third pivot axis which is positionally fixed with respect to the unitary, rigid base segment and to the unitary, rigid leg support segment;

the unitary, rigid leg support segment being connected to the unitary, rigid seat surface segment by a second bracket;

the second bracket being pivotable in relation to the unitary, rigid leg support segment about a fourth pivot axis which is positionally fixed with respect to the unitary, rigid leg support segment and to the second bracket; and the second bracket also being pivotable in relation to the unitary, rigid leg support segment about a fifth pivot axis which is positionally fixed with respect to the unitary, rigid seat surface segment and to the second bracket.

14. The item of seating furniture according to claim 13, wherein:

the unitary, rigid seat surface segment comprises:

a seat frame which supports the seat surface at least on a right-hand side and a left-hand side and a front side of the seat surface; and an extension arm part which is fixedly and non-rotatably connected to the seat frame; and the second pivot axis and the fifth pivot axis are hinged to the extension arm part.

15. The item of seating furniture according to claim 14, wherein:

the second pivot axis and the fifth pivot axis are colinear in both the storage position and the use position.

16. The item of seating furniture according to claim 13, wherein:

the unitary, rigid base segment is provided with a stop preventing further movement of the unitary, rigid leg support segment or the second bracket when the unitary, rigid leg support segment moved to the use position.

17. The item of seating furniture according to claim 13, wherein the second bracket is oriented substantially vertically when the unitary, rigid leg support segment is arranged in the use position.

* * * * *